US006157299A

United States Patent [19]

Wang

[11] Patent Number: 6,157,299

[45] **Date of Patent: *Dec. 5, 2000**

[54] PROCESS OF REDUCING MOTION-TYPE FALSE ALARM OF SECURITY ALARM SYSTEM WITH MULTIPLE TIME-SETTING ADJUSTMENT CONTROL

[76] Inventor: Randall Wang, 5209 N.Tyler Ave., Temple City, Calif. 91780

[ * ] Notice: This patent is subject to a terminal disclaimer.

[21] Appl. No.: 09/387,681

[22] Filed: Aug. 31, 1999

[51] Int. Cl.[7] ..... G08B 29/00

[52] U.S. Cl. ..... 340/506; 507/541; 507/565; 507/527; 40/44

[58] Field of Search ..... 340/506, 507, 340/511, 527, 528, 541, 565; 379/39, 40, 44

[56] References Cited

U.S. PATENT DOCUMENTS 4,994,787 2/1991 Kratt et al. ..... 340/505
5,083,106 1/1992 Kostusiak et al. ..... 340/506
5,686,896 11/1997 Bergman ..... 340/636
5,801,625 9/1998 Wang ..... 340/506

*Primary Examiner*—Darryl Pope
*Attorney, Agent, or Firm*—Raymond Y. Chan; David and Raymond

[57] ABSTRACT

In order to enhance the process of reducing motion-type false alarm of security alarm system, a multiple time-setting adjustment control is employed in the process of reducing motion-type false alarm of security alarm system automatically or manually, wherein a cross zone delaying period during the verification condition for a second detecting signal from another motion sensor is set to have a longer time period than a single zone delaying period during the verification condition for a second detecting signal from the same motion sensor, so as to further effectively reduce the motion-type false alarm possibility without reducing the protection performance of the security alarm system.

16 Claims, 3 Drawing Sheets

PROCESS OF REDUCING MOTION-TYPE FALSE ALARM OF SECURITY ALARM SYSTEM WITH MULTIPLE TIME-SETTING ADJUSTMENT CONTROL

BACKGROUND OF THE PRESENT INVENTION

1. Field of the Present Invention

The present invention relates to a process of minimizing false alarm for security alarm system having motion sensors, and more particular to further development on a U.S. patent application Ser. No. 09/145,403, filed Sep. 2, 1998, now allowed as U.S. Pat. No. 5,917,409.

2. Description of Related Arts

As introduced in U.S. patent application Ser. No 09/315,934, it is reported that less than 5% of the triggered alarms are caused by actual illegal events. More than 90% of the triggered alarms are false alarms caused by the motion sensors and human misoperations. False alarms are the unsolved troublesome to both the alarm companies and the police resources. The whole country suffers an unreasonable waste of time and police force. Before the policemen arrive at the sense, no one knows that whether it is a false alarm or an actual alarm. Therefore, the local police resource charges the alarm owner for a pretty high amount of false alarm operation fee for each false alarm and most of the users have a lot of compliant about that too. It creates a great burden to the limited police force in every city. In fact, millions expense have been wasted for the police resources in responding the false alarms, that greatly degrades the efficiency and performance of the police. Accordingly, some of the police stations in this country consider abandoning such alarm response service. It will only be good news to all burglars. Therefore, how to effectively minimize the possibility of false alarm becomes an urgent topic to both the alarm users and the police resources.

In U.S. Pat. No. 5,917,409, the applicant successfully suggests a novel process and system for reducing motion-type false alarm of security alarm system, which effectively minimize the possibility of false alarm and substantially prevent the waste of police force as well as the unreasonable false alarm operation fee charged by the police to lo the alarm owner.

In U.S. patent application Ser. No. 09/315,934, the applicant further develops a self-analyzing and self-adjusting process to adjust the duration of the delay period during the verification condition according to the substantial needs, so as to ensure the best security and minimizes the false alarm.

In fact, motion-type false alarms are commonly caused by animal, insect, balloon, temperature, lighting, and other environment effect, etc. According to the recorded statistics data, more than 95% of the motion-type false alarm is caused by "single zone trigger" and less than 5% of the motion-type false alarm is caused by "cross zone trigger", i.e. more than one zones trigger, within a certain period of time such as 10 to 30 minutes. In which, each motion sensor is installed to monitor a respective motion detecting area, i.e. a security zone such as a room in a building. The "single zone trigger" of the security alarm occurs when the same motion sensor located in a respective security zone detects two or more activities within a predetermined period of time. The "cross zone trigger" of the security alarm occurs when two or more motion sensors located in different security zones detect two or more activities respectively within a predetermined period of time.

In other words, if more than one motion-type sensors (detectors) which are monitoring different security zones are triggered during the predetermined period of time, such as 10 or 30 minutes, there is a very high possibility, more than 95%, that it is caused by intruder breaking in or human activities occurred through different security zones.

On the other hand, it is a well known headache that despite the new features, motion sensors based solely on PIR technology and "single zone" operation still reach hard limits in the balance between catch performance and false alarm immunity.

SUMMARY OF THE PRESENT INVENTION

Therefore, in order to further enhance the applicant's process of reducing motion-type alarm of security alarm system, it is a main object of the present invention to provide a process of reducing motion-type false alarm of security alarm system with multiple time-setting adjustment control, in which the cross zone delaying period for "cross zone trigger" is set to have a longer period of time than the single zone delaying period for "single zone trigger", so as to further effectively reduce the motion-type false alarm possibility without reducing the protection performance of the security alarm system.

Another object of the present invention is to provide a process of reducing motion-type false alarm of security alarm system with multiple time-setting adjustment control, wherein the cross zone delay period for every two motion sensors is proportional to the distance between said two motion sensors. In other words, the more far away between two motion sensors, the delay period for verification condition between them is set with a longer period of time.

A further object of the present invention is to provide a process of reducing motion-type false alarm of security alarm system with multiple time-setting, adjustment control, wherein a self-analyzing and self-adjusting control is also employed to properly adjust the duration of both the single zone delay period and the cross zone delay period respectively according to the substantial needs, so as to ensure the best security and minimizes the false alarm.

In order to accomplish the above objects, a multiple time-setting adjustment control is employed in the process of reducing motion-type false alarm of security alarm system automatically or manually, wherein a cross zone delaying period during the verification condition for a second detecting signal from another motion sensor is set to have a longer time period than a single zone delaying period during the verification condition for a second detecting signal from the same motion sensor.

Moreover, each of the preset signal zone and cross zone time periods of the signal zone delaying period and the cross zone delaying period during the verification condition is reduced to a shorter first adjusted time period when a second alarm trigger is occurred after the first alarm trigger during the preset time period.

If a third alarm trigger is occurred during the first adjusted time period, the signal zone delaying period or the cross zone delaying period is further reduced to a second adjusted time period shorter than the first adjusted time period. The respective signal zone or cross zone delaying period will be further reduced when subsequent alarm trigger occurred. However, if there is no third alarm trigger occurred during the first adjusted time period, or there is no subsequent alarm trigger occurred after the last alarm trigger during the latest reduced adjusted time period, the respective signal zone or cross zone delaying period will be reset to the preset signal zone or cross zone time period.

DETAILED DESCRIPTION OF THE PREFERRED EMBODIMENT

Figure 1:
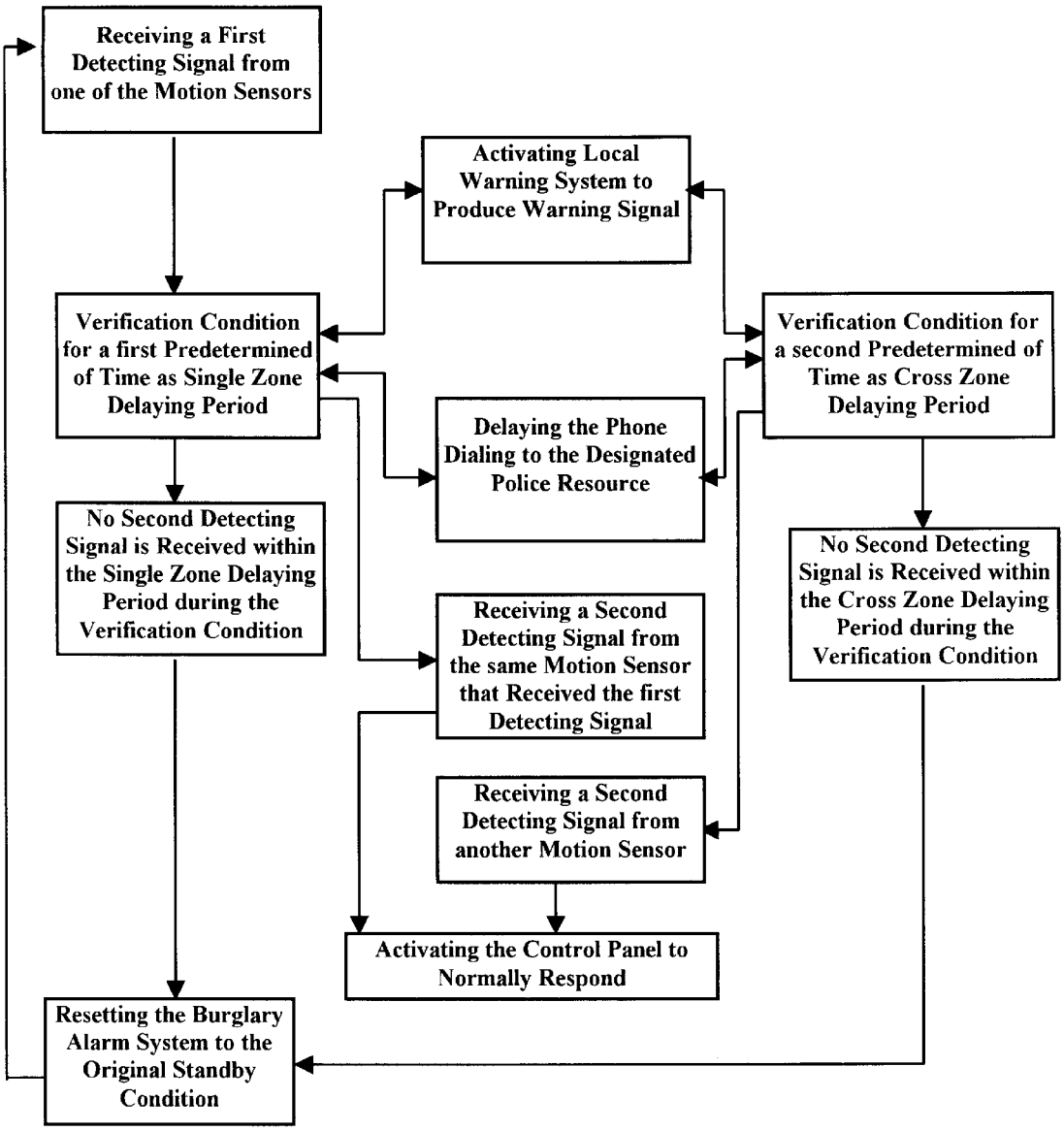
FIG. 1 is a block diagram of a process system of reducing motion-type false alarm of security alarm system with multiple time-setting adjustment control according to a first preferred embodiment of the present invention.

According to the applicant's previous U.S. Pat. No. 5,917,409, a process for reducing motion-type false alarm of security alarm system is disclosed, which enables the security alarm system to process self-verification steps before calling the police and is adapted to all kinds of current security alarm system which comprises a CPU operated control panel, a local warning system electrically connected to the control panel (CPU), a plurality of motion sensors which are respectively installed at different motion detecting areas for monitoring various security zones and electrically connected to the control panel (CPU), a phone dialing system such as a dialer which is built in the control panel for transmitting digital signals to a central station for dispatching to the designated police resource when it is activated.

The process for reducing motion-type false alarm of a security alarm system, which is activated by the alarm user by keying in the security code into an activating and de-activating keypad, comprises the steps as follows.

1. Activate the local warning system to produce local warning sound for a predetermined period of time, normally two to five minutes, when any one of the motion sensors detects a first motion everytime within the respective motion detecting area.

2. Delay to activate the control panel as well as the built-in phone dialing system for a preset time period as a delaying period, wherein the security alarm system is in a verification condition during such delaying period.

3. Activate the control panel to normally respond by activating the local warning system or any other warning systems and, at the same time, the built-in phone dialing system to transmit digital signals to the central station for dispatching to the designated police resource when at least one more detecting signal is sent from one of the motion sensors that detects a second motion within the respective motion detecting area during the verification condition, i.e. within the delaying period.

4. However, if there is no other detecting signal sent from any motion sensor within the predetermined period of time, the security alarm system is reset to the original standby condition. In other words, if there is no second motion detected by any motion sensor during the verification condition, the security alarm system will be automatically reset to the standby condition, so that the standby security alarm system is ready to enter the verification condition again if there is another first motion detected by any of the motion sensors again.

Furthermore, in step (1), a detecting signal is sent from the motion sensor which detects the motion to the control panel to activate the local warning system to produce the local warning signal. If the particular detecting signal continues transmitting for a predetermined period of time, generally speaking 2 to 5 minutes, the above step (3) will automatically process.

It is a simple alternative that, in step 1, the local warning system is set to provide no response yet when any one of the motion sensors detects a first motion everytime until any one of the motion sensors detects a second motion within a predetermined period of time. If there is no second motion detected, the system is reset to normal condition. If there is a second motion detected, the system processes to the step 2 for monitoring a third detecting signal from one of the motion sensors when a third motion is detected and thus activating the control panel to normally respond.

According to the process of reducing motion-type false alarm of a security alarm system as mentioned above, the second motion may be occurred in the same security zone and detected by the same motion sensor which detected the first motion, or that the second motion can also be occurred in another security zone and detected by another motion sensor.

If the first and second motions are detected in the same security zone and by the same motion sensor within the delaying period during the verification condition, we call such situation as "single zone trigger". If the first and second motions are detected in different security zones and by different motion sensors within the delaying period during the verification condition, we call such situation as "cross zone trigger".

As described above, according to the recorded statistics data, more than 95% of the motion-type false alarm is caused by "single zone trigger" and less than 5% of the motion-type false alarm is caused by "cross zone trigger", i.e. more than one zones trigger, within a certain period of time such as 10 to 30 minutes. In other words, if more than one motion-type sensors (detectors) which are monitoring different security zones are triggered during the predetermined period of time, such as 10 or 30 minutes, there is a very high possibility, more than 95%, that it is caused by intruder breaking in or human activities occurred through different security zones.

In view of above, in order to further enhance the applicant's process of reducing motion-type alarm of security alarm system, the cross zone delaying period for "cross zone trigger" can be set to have a longer period of time than the single zone delaying period for "single zone trigger", so as to further effectively reduce the motion-type false alarm possibility without reducing the protection performance of the security alarm system.

Therefore, as shown in FIG. 1, the process of reducing motion-type false alarm of security alarm system with multiple-setting adjustment control comprises the steps as follows.

(a) Activate the local warning system to produce local warning signal for a designated period of time when one of the motion sensors detects a trigger motion within a respective security zone (motion detecting area) during a standby condition of the security alarm system.

(b) Delay to activate the control panel as well as the phone dialing system for a first preset time period as a single zone delaying period and at least a second preset time period as a cross zone delaying period which is longer than the single zone delaying period.

(c) Activate the control panel to normally respond by activating the local warning system to produce warning signals and the phone dialing system to transmit digital signals to the central station when the same motion sensor that detected the trigger motion detects another motion in the same security zone within the single zone delaying period during the verification condition.

(d) Activate the control panel to normally respond by activating the local warning system to produce warning signals and the phone dialing system to transmit digital signals to the central station when another motion sensor detects another motion in another security zone within the cross zone delaying period during the verification condition.

(e) Reset the security alarm system to the original standby condition when there is no other motion is detected by any motion sensors during the verification condition, wherein the standby security alarm system is ready to enter the verification condition again when there is motion detected by any of the motion sensors again.

The preset time period of the single zone delaying period P in step (2) is generally determined by the motion-type sensor density X obtained from the following equation:

X=Total Square Feet Protected in the Premises/Number of Motion Sensors used

When X<500, the time period is preferred to be set at 1–5 minutes, P1.

When 500≦X≦3000, the time period is preferred to be set at 5–15 minutes, P2.

When X>3000, the time period is preferred to be set at 15–30 minutes, P3.

The single zone delaying period P can be set between 1 minutes to 30 minutes or selected from P1, P2 or P3 according to the value X with respect to the total square feet protected in the premises.

After the single zone delaying period P is set, the cross zone delaying period is preferred to set with a second time period longer than the single zone delaying period P, such as P (×2, ×3, ×4 . . . ×10, etc.), depending on the motion-type sensor density (and/or quality). Generally, a higher density of the motion sensors, a shorter time period for both the single zone and cross zone delaying periods is required.

To a smaller total protected area, because the distance between every two motion sensors will not be too far away, one standard cross zone delaying period can be set for all motion sensors, such as P×2, that is the responsive To a large protected area, the cross zone delaying periods may vary according to the protected area A monitored between the two motion sensors, wherein When A<500 square feet, the time period of the respective cross zone delaying, period for the two motion sensors is preferred to be set at 1–5 minutes, P1.

When 500≦A≦3000 square feet, the time period of the respective cross zone delaying period for the two motion sensors is preferred to be set at 5–15 minutes, P2.

When A>3000, the time period of the respective cross zone delaying period for the two motion sensors is preferred to be set at 15–30 minutes, P3.

For example, there are totally three motion sensors M1, M2, M3 installed to respectively monitor three room in a structure having a 1200 square feet area. Moreover, the protected area between the first motion sensor M1 and the second motion sensor M2 is 450 square feet. The protected area between the second motion sensor M2 and the third motion sensor M3 is 900 square feet. The protected area between the first motion sensor M1 and the third motion sensor M3 is 550 square feet.

Accordingly, the motion-type sensor density X equals to 400 square fee, so that the single zone delaying period should be set as P1 (1–5 minutes), for example 5 minutes. Moreover, the cross zone delaying period can be set by the following two methods:

(a) Simply set the cross zone delaying period between every two motion sensors as P1×2, e.g. 5 minutes×2=10 minutes.

(b) Set the cross zone delaying period between the first and second motion sensors M1–M2 as P1 (1–5 minutes), such as 5 minutes. Set the cross zone delaying period between the second and third motion sensors M2–M3 as P2 (5–15 minutes), such as 15 minutes. Set the cross zone delaying period between the first and third motion sensors M1–M3 as P2 (5–15 minutes), such as 10 minutes.

In view of above, the process for reducing motion-type false alarm of security alarm system as disclosed in U.S. Pat. No. 5,917,409 can be employed with the multiple time-setting adjustment control to effectively enhance the reduction of the motion-type false alarm possibility without reducing the protection performance of the security alarm system.

Figure 3:
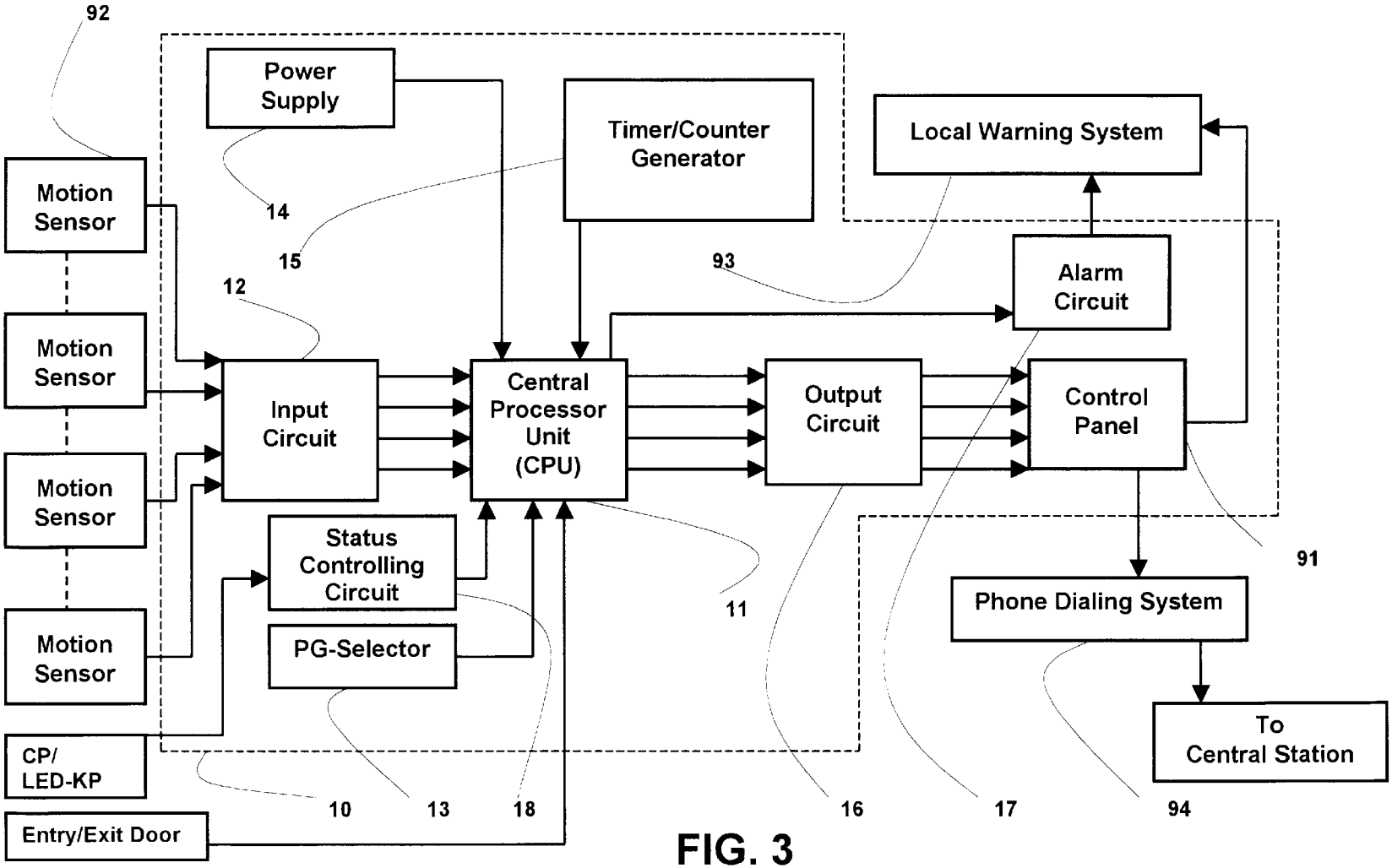
FIG. 3 is a block diagram of a system for reducing motion-type false alarm of security alarm system according to the present invention.

Furthermore, the multiple time-setting adjustment control of the present invention can be applied to the U.S. patent application Ser. No. 09/315,934 to employ with the self-analyzing and self-adjusting control. In order to process the self-verification steps, a self-verification system 10 can either be integrally built-in a control panel or be connected between the control panel 91 and the motion sensors 92 of the conventional security alarm system as disclosed in the previous application, as shown in FIG. 3. In other words, all the motion sensors 92 are connected to the self-verification system 10 before connecting to the control panel 91, so that all detecting signals sent from the motion sensors 92 will first be detected by the self-verification system 10 which controls whether the detecting signal should be sent to the control panel 91 to trigger the alarm system by activating the local warning system 93 and the phone dialing system 94. Besides, the local warning system 93 is also first connected to the self-verification system 10 before connecting to the control panel 91.

It is worth to describe the self-verification system 10 in this application again, so that no referral to the previous application is needed in order to better understand how the multiple time-setting adjustment control of the present invention effectively works. The self-verification system 10 for reducing motion-type false alarm of a security alarm system comprises a central processor unit (CPU) 11 which is a central controller for computation and loading designated software for controlling the following associate circuits, an input circuit 12 which is connected with the CPU 11 having a plurality of input terminals for respectively connecting the motion sensors 92 of the security alarm system with the CPU 11, a PG-selector 13 which comprises a switch circuit connected with the CPU 11 for setting the CPU 11 to select and program the standby period and functions of the system 10, a power supply circuit 14 connected with the CPU 11 for purifying electrical power received from the control panel 91 of the security alarm system before sending to the CPU 11 by stabilizing voltage and eliminating interference frequency and noise, a timer/counter generator circuit 15 connected with the CPU 11 for venerating counter signals which are pulse signals for counting a preset standby period of the verification condition, an output circuit 16 having a plurality of output terminals with respect to the motion sensors 92 for connecting the CPU 11 with the control panel 91 of the security alarm system, an alarm output 17 connecting the CPU 11 with the local warning system 93, which generally comprises the audible device and visual device, for activating local security electrical actions of the security alarm system, and a status controlling circuit 18 connected with the CPU for notifying the self-verification system 10 whether the security alarm system is in arming or disarming status, wherein the status controlling circuit 18 disables the self-verification system 10 when the security alarm system is in disarming status and activate the self-verification system 10 when the security alarm system is in arming status.

When any of the motion sensors 92 of the standby security alarm system detects a trigger motion within a security zone, a first detecting signal is sent from the corresponding motion sensor 92 to CPU 11 of the self-verification system 10 via the input circuit 12. The first detecting signal will first enter the self-verification system 10 and activate it to the verification condition. Then, the timer/counter generator circuit 15 will start to generate pulse signals for counting a single zone delaying period and at least a longer cross zone delaying period. During the counting of the single zone and cross zone delaying periods, the self-verification system is in the verification condition. At that moment, the CPU 11 of the self-verification system 10 holds the first detecting signal here and only triggers the local warning system 93 to provide audible and/or visual signals through the alarm output 17. In other words, during the verification condition, the first detecting signal will not enter and trigger the control panel 91.

If an intruder enters the building and is detected by any one of the motion sensors 92, the intruder would either search around for larceny or try to escape because of the warning sound produced. Therefore, the same motion or another motion sensor 92 would certainly detect the intruder's activity within the single zone delaying period or the cross zone delaying period respectively and send out a second detecting signal to the self verification system 10. When the self-verification system 10 receives two or more detecting signals from the different motion sensors 92 or from the same motion sensor 92 under certain circumstances, the self-verification system 10 would immediately trigger the control panel 91 to normally respond by fully activating the local warning system 93 and any other warning system as well as the built-in phone dialing system 94 to transmit digital signals to a central station for dispatching to the designated police resource. In addition, the number of detecting signals required to be received by the self-verification system 10 during the verification condition before the control panel 91 is triggered and the duration of the predetermined period of time for the verification condition can be preset in the self-verification system 10 by the user according to different situations and environments.

Furthermore, the logic algorithm as introduced in the U.S. patent application Ser. No. 09/315,934 can also employed with the above process of the present invention to provide a self-analyzing and self-adjusting control respectively to the single zone delaying period and the cross zone delaying period in the verification condition, so as to ensure the best security and minimizes the false alarm.

Figure 2:
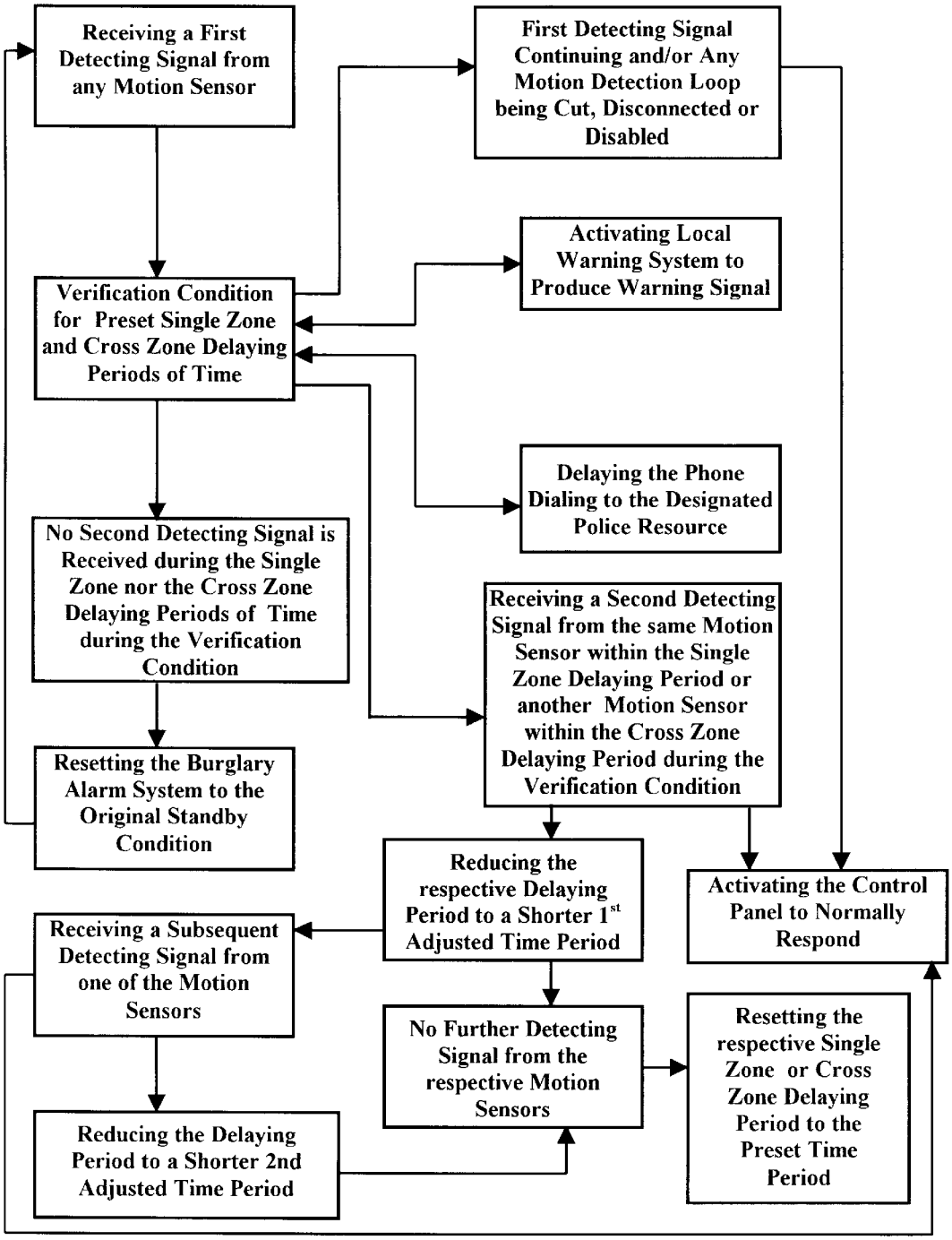
FIG. 2. is a block diagram of a process system of reducing motion-type false alarm of security alarm system with both a multiple time-setting adjustment control and a self-analyzing and self-adjusting control according to a second preferred embodiment of the present invention.

As shown in FIGS. 2 and 3, a second preferred embodiment of the present invention is illustrated, wherein a digital time counter for diagnostic counting-up can be employed in the false alarm reduction system and the single zone and cross zone delaying periods can be preset in the PG-Selector 13. A plurality of selection buttons can be provided in the false alarm reduction system. For example, three time periods, P1 (5 minutes), P2 (10 minutes) and P3 (25 minutes) can all be preset for selection. The users may select the appropriate time period as the single zone and cross zone delaying periods, P1×2, P2×2or P3×2, to fit their substantial needs.

Also, proper adjustment can be made by analyzing result with the number of false alarms and the number of actual triggers recorded on DDC or by central station in a specific period of time, 3 months, half a year, or one year. For example, if the original single zone delaying period is preset to P2, 10 minutes, and the cross zone delaying period is preset to P2×2, i.e. 20 minutes.

If the $$\frac{\text{Number of Motion Sensor False Alarms}}{\text{Number of Actual Triggers}} \times 100\% \leq 10\%,$$

the original preset single zone delaying period and cross zone delaying period are all right.

If the $$\frac{\text{Number of Motion Sensor False Alarms}}{\text{Number of Actual Triggers}} \times 100\% \geq 10\%,$$

the original preset single zone delaying period needs to be set to P1 from P2 or to P2 from P3, or the original preset cross zone delaying period needs to be set to P1×2 from P2×2 or to P2×2 from P3×2.

Or that, make other adjustments like replacing with higher quality motion sensors, adjusting motion sensors' locations, and/or improving environment inside the building.

According to the present invention, after receiving the second detecting signal from the same motion sensor that detected the first motion during the preset time period of the single zone delaying period or from another motion sensor during the preset time period of the corresponding cross zone delaying period in the verification condition, further comprising the steps of (a) reducing the time period of the respective single zone delaying period or cross zone delaying period in the verification condition in step (2) to a shorter adjusted time period;

(b) activating the control panel to normally respond by activating the local warning system or any other warning systems and, at the same time, the built-in phone dialing system to transmit digital signals to the central station for selectively dispatching to the designated police resource when at least one more subsequent detecting signal is sent from the same motion sensor which detected the first motion or another motion sensor while detecting a subsequent motion within the respective security zone (motion detecting area), and repeating the above (a) to further reduce the time period of the respective single zone delaying period or cross zone delaying period; and (c) resetting the shorter adjusted time period of the single zone delaying period or the cross zone delaying period to the original preset time period when there is no subsequent detecting signal sent from the same motion sensors or any other one of the motion sensors that detects a subsequent motion within the respective security zone.

It is worth to also mention that in order to further verify whether there is an intruder who has broken in the motion detecting areas and cut, disconnected or disabled any of the motion detection loops, an additional step can be included, after the step (2), in the process for reducing motion-type false alarm of a security alarm system, that is to activate the control panel to normally respond by activating local warning system to produce warning signals and the phone dialing system to transmit digital signals to the central station when the motion sensor that detected the first motion continuously sends out a detecting signal for a predetermined period of time, or any one of the motion detection loops is cut, disconnected or disabled.

In view of above, the present invention substantially reduces the single zone verification period (single zone delaying period) to enhance false alarm reduction performance. Besides, the present invention extends the cross zone verification period (cross zone delaying period) to enhance the devices and system protection without sacrificing the safety performance.

What is claimed is:

1. A process of reducing motion-type false alarm of a security alarm system, which comprises a control panel (CPU), a local warning system electrically connected to the control panel, a plurality of motion sensors which are respectively installed at a plurality of motion detecting areas and electrically connected to the control panel, a dialing system being built in the control panel for transmitting signals to a central station for dispatching to a designated police resource when the dialing system is activated, comprising the steps of:

(a) activating the local warning system to produce local warning signal for a designated period of time when one of the motion sensors detects a trigger motion within a respective motion detecting area during a standby condition of the security alarm system;

(b) delaying to activate the control panel as well as the dialing system for a first preset time period as a single zone delaying period and at least a second preset time period as a cross zone delaying period which is longer than the single zone delaying period, wherein said security alarm system is in a verification condition during said single zone and cross zone delaying periods;

(c) activating the control panel to normally respond by activating the local warning system to produce warning signals and the dialing system to transmit digital signals to the central station when the same motion sensor that detected the trigger motion detects another motion in the same motion detecting area within the single zone delaying period during the verification condition;

(d) activating the control panel to normally respond by activating the local warning system to produce warning signals and the phone dialing system to transmit digital signals to the central station when another motion sensor detects another motion in another motion detecting area within the cross zone delaying period during the verification condition; and (e) resetting the security alarm system to the original standby condition when there is no other motion is detected by any motion sensors during the verification condition, wherein the standby security alarm system is ready to enter the verification condition again when there is motion detected by any of the motion sensors again.

2. A process of reducing motion-type false alarm of a security alarm system, as recited in claim 1, wherein the time period of the cross zone delaying period is at least twice the time period of the single zone delaying period.

3. A process of reducing motion-type false alarm of a security alarm system, as recited in claim 1, wherein the single zone delaying period is determined according to a motion sensor density obtained by dividing a total protected area with a total number of the motion sensors used.

4. A process of reducing motion-type false alarm of a security alarm system, as recited in claim 1, wherein a specific time period of the cross zone time period is preset with respect to different protected area between every two of the motion sensors.

5. A process of reducing motion-type false alarm of a security alarm system, as recited in claim 3, wherein a specific time period of the cross zone time period is preset with respect to different protected area between every two of the motion sensors.

6. A process of reducing motion-type false alarm of a security alarm system, as recited in claim 1, after step (b), further comprising a step of activating the control panel to normally respond by activating the local warning system to produce warning signals and the phone dialing system to transmit digital signals to the central station when the motion sensor that detected the first motion continuously sends out a detecting signal for a predetermined period of time, or any one of the motion detection loops is cut, disconnected or disabled.

7. A process of reducing motion-type false alarm of a security alarm system, as recited in claim 1, after step (e), further comprising the steps of:

(f) reducing the preset time period of the single zone delaying period to a shorter adjusted time period when the second motion is detected by the same motion sensor, which detected the trigger motion, in the same motion detecting area within the preset time period of the single zone delaying period during the verification condition;

(g) resetting the single zone delaying period from the adjusted time period back to the preset time period when no subsequent motion is detected in the same motion detecting area within the adjusted time period;

(h) repeating the above step (e) and further reducing the adjusted time period of the single zone delaying period to a second adjusted time period when at least one more subsequent detecting signal is sent from the same motion sensor, which detected the trigger motion, after detecting a subsequent motion within the same motion detecting area; and (i) resetting the single zone delaying period from the adjusted time period back to the preset time period when no subsequent motion is detected in the same motion detecting area within the second adjusted time period.

8. A process of reducing motion-type false alarm of a security alarm system, as recited in claim 2, after step (e), further comprising the steps of:

(f) reducing the preset time period of the single zone delaying period to a shorter adjusted time period when the second motion is detected by the same motion sensor, which detected the trigger motion, in the same motion detecting area within the preset time period of the single zone delaying period during the verification condition;

(g) resetting the single zone delaying period from the adjusted time period back to the preset time period when no subsequent motion is detected in the same motion detecting area within the adjusted time period;

(h) repeating the above step (e) and further reducing the adjusted time period of the single zone delaying period to a second adjusted time period when at least one more subsequent detecting signal is sent from the same motion sensor, which detected the trigger motion, after detecting a subsequent motion within the same motion detecting area; and (i) resetting the single zone delaying period from the adjusted time period back to the preset time period when no subsequent motion is detected in the same motion detecting area within the second adjusted time period.

9. A process of reducing motion-type false alarm of a security alarm system, as recited in claim 3, after step (e), further comprising the steps of:

(f) reducing the preset time period of the single zone delaying period to a shorter adjusted time period when the second motion is detected by the same motion sensor, which detected the trigger motion, in the same motion detecting area within the preset time period of the single zone delaying period during the verification condition;

(g) resetting the single zone delaying period from the adjusted time period back to the preset time period when no subsequent motion is detected in the same motion detecting area within the adjusted time period;

(h) repeating the above step (e) and further reducing the adjusted time period of the single zone delaying period to a second adjusted time period when at least one more subsequent detecting signal is sent from the same motion sensor, which detected the trigger motion, after detecting a subsequent motion within the same motion detecting area; and (i) resetting the single zone delaying period from the adjusted time period back to the preset time period when no subsequent motion is detected in the same motion detecting area within the second adjusted time period.

10. A process of reducing motion-type false alarm of a security alarm system, as recited in claim 4, after step (e), further comprising the steps of:

(f) reducing the preset time period of the single zone delaying period to a shorter adjusted time period when the second motion is detected by the same motion sensor, which detected the trigger motion, in the same motion detecting area within the preset time period of the single zone delaying period during the verification condition;

(g) resetting the single zone delaying period from the adjusted time period back to the preset time period when no subsequent motion is detected in the same motion detecting area within the adjusted time period;

(h) repeating the above step (e) and further reducing the adjusted time period of the single zone delaying period to a second adjusted time period when at least one more subsequent detecting signal is sent from the same motion sensor, which detected the trigger motion, after detecting a subsequent motion within the same motion detecting area; and (i) resetting the single zone delaying period from the adjusted time period back to the preset time period when no subsequent motion is detected in the same motion detecting area within the second adjusted time period.

11. A process of reducing motion-type false alarm of a security alarm system, as recited in claim 5, after step (e), further comprising the steps of:

(f) reducing the preset time period of the single zone delaying period to a shorter adjusted time period when the second motion is detected by the same motion sensor, which detected the trigger motion, in the same motion detecting area within the preset time period of the single zone delaying period during the verification condition;

(g) resetting the single zone delaying period from the adjusted time period back to the preset time period when no subsequent motion is detected in the same motion detecting area within the adjusted time period;

(h) repeating the above step (e) and further reducing the adjusted time period of the single zone delaying period to a second adjusted time period when at least one more subsequent detecting signal is sent from the same motion sensor, which detected the trigger motion, after detecting a subsequent motion within the same motion detecting area; and (i) resetting the single zone delaying period from the adjusted time period back to the preset time period when no subsequent motion is detected in the same motion detecting area within the second adjusted time period.

12. A process of reducing motion-type false alarm of a security alarm system, as recited in claim 1, after step (e), further comprising the steps of:

(f) reducing the preset time period of the cross zone delaying period to a shorter adjusted time period when the second motion is detected by one of the other motion sensors in one of the other motion detecting areas within the preset time period of the cross zone delaying period during the verification condition;

(g) resetting the cross zone delaying period from the adjusted time period back to the preset time period when no subsequent motion is detected in any one of the other motion detecting areas within the adjusted time period;

(h) repeating the above step (e) and further reducing the adjusted time period of the cross zone delaying period to a second adjusted time period when at least one more subsequent detecting signal is sent from one of the other motion sensors that detects a subsequent motion within the other motion detecting area; and (i) resetting the cross zone delaying period from the adjusted time period back to the preset time period when no subsequent motion is detected in the other motion detecting area within the second adjusted time period.

13. A process of reducing motion-type false alarm of a security alarm system as recited in claim 2, after step (e), further comprising the steps of:

(f) reducing the preset time period of the cross zone delaying period to a shorter adjusted time period when the second motion is detected by one of the other motion sensors in one of the other motion detecting areas within the preset time period of the cross zone delaying period during the verification condition;

(g) resetting the cross zone delaying period from the adjusted time period back to the preset time period when no subsequent motion is detected in any one of the other motion detecting areas within the adjusted time period;

(h) repeating the above step (e) and further reducing the adjusted time period of the cross zone delaying period to a second adjusted time period when at least one more subsequent detecting signal is sent from one of the other motion sensors that detects a subsequent motion within the other motion detecting area; and (i) resetting the cross zone delaying period from the adjusted time period back to the preset time period when no subsequent motion is detected in the other motion detecting area within the second adjusted time period.

14. A process of reducing motion-type false alarm of a security alarm system, as recited in claim 3, after step (e), further comprising the steps of:

(f) reducing the preset time period of the cross zone delaying period to a shorter adjusted time period when the second motion is detected by one of the other motion sensors in one of the other motion detecting areas within the preset time period of the cross zone delaying period during the verification condition;

(g) resetting the cross zone delaying period from the adjusted time period back to the preset time period when no subsequent motion is detected in any one of the other motion detecting areas within the adjusted time period;

(h) repeating the above step (e) and further reducing the adjusted time period of the cross zone delaying period to a second adjusted time period when at least one more subsequent detecting signal is sent from one of the other motion sensors that detects a subsequent motion within the other motion detecting area; and (i) resetting the cross zone delaying period from the adjusted time period back to the preset time period when no subsequent motion is detected in the other motion detecting area within the second adjusted time period.

15. A process of reducing motion-type false alarm of a security alarm system, as recited in claim 4, after step (e), further comprising the steps of:

(f) reducing the preset time period of the cross zone delaying period to a shorter adjusted time period when the second motion is detected by one of the other motion sensors in one of the other motion detecting areas within the preset time period of the cross zone delaying period during the verification condition;

(g) resetting the cross zone delaying period from the adjusted time period back to the preset time period when no subsequent motion is detected in any one of the other motion detecting areas within the adjusted time period;

(h) repeating the above step (e) and further reducing the adjusted time period of the cross zone delaying period to a second adjusted time period when at least one more subsequent detecting signal is sent from one of the other motion sensors that detects a subsequent motion within the other motion detecting area; and (i) resetting the cross zone delaying period from the adjusted time period back to the preset time period when no subsequent motion is detected in the other motion detecting area within the second adjusted time period.

16. A process of reducing motion-type false alarm of a security alarm system, as recited in claim 5, after step (e), further comprising the steps of:

(f) reducing the preset time period of the cross zone delaying period to a shorter adjusted time period when the second motion is detected by one of the other motion sensors in one of the other motion detecting areas within the preset time period of the cross zone delaying period during the verification condition;

(g) resetting the cross zone delaying period from the adjusted time period back to the preset time period when no subsequent motion is detected in any one of the other motion detecting areas within the adjusted time period;

(h) repeating the above step (e) and further reducing the adjusted time period of the cross zone delaying period to a second adjusted time period when at least one more subsequent detecting signal is sent from one of the other motion sensors that detects a subsequent motion within the other motion detecting area; and (i) resetting the cross zone delaying period from the adjusted time period back to the preset time period when no subsequent motion is detected in the other motion detecting area within the second adjusted time period.

* * * * *